US006516550B1

(12) United States Patent
Schnyder et al.

(10) Patent No.: US 6,516,550 B1
(45) Date of Patent: Feb. 11, 2003

(54) IMPACT PROTECTION DEVICE

(75) Inventors: Rolf Schnyder, Falsterbo (SE); Kent Sandstroům, Malmö (SE)

(73) Assignee: Wepro AB, Malmo (SE)

( * ) Notice: Subject to any disclaimer, the term of this patent is extended or adjusted under 35 U.S.C. 154(b) by 0 days.

(21) Appl. No.: 09/914,882

(22) PCT Filed: Feb. 1, 2000

(86) PCT No.: PCT/SE00/00197

§ 371 (c)(1),
(2), (4) Date: Sep. 5, 2001

(87) PCT Pub. No.: WO00/46566

PCT Pub. Date: Aug. 10, 2000

(30) Foreign Application Priority Data

Feb. 2, 1999 (SE) ..... 9900357

(51) Int. Cl.[7] ..... F41A 35/04
(52) U.S. Cl. ..... 42/96
(58) Field of Search ..... 42/96

(56) References Cited

U.S. PATENT DOCUMENTS 1,258,283 A * 3/1918 Weyand ..... 42/96
2,545,473 A * 3/1951 Kremkau ..... 42/96
2,558,792 A * 7/1951 Snowden ..... 42/96
3,063,184 A * 11/1962 Sukala, Jr. ..... 42/96
3,354,569 A * 11/1967 Kassabian ..... 42/96
3,570,703 A 3/1971 MacRae ..... 220/29
D271,126 S * 10/1983 Doak ..... D22/108
4,817,322 A * 4/1989 Dietz et al. ..... 42/96
4,908,971 A * 3/1990 Chaney ..... 42/70.11
5,105,571 A * 4/1992 Kinchin et al. ..... 42/96
6,019,404 A * 2/2000 Pasquale ..... 294/1.1
6,176,032 B1 * 1/2001 Cohen et al. ..... 42/96

* cited by examiner

*Primary Examiner*—Charles T. Jordan
*Assistant Examiner*—Jordan M. Lofdahl
(74) *Attorney, Agent, or Firm*—Ladas & Parry

(57) ABSTRACT

An impact protection device (1) for a weapon which is disposed, in use, to surround the barrel of the weapon at least in its muzzle region. The device has material portions which resist in mechanical forces applied against the weapon in these portions so that the portions are deformed. In order to improve the impact absorption and also for purposes of saving material, the impact absorbing part (1*a*) is provided with grooves and flanges (5). The form of the impact-absorbing part is adapted to the form of each respective weapon. Three variations are provided, one for surrounding the barrel of the weapon, another for surrounding a flash-guard (14), and a third for surrounding equipment for firing blank ammunition.

22 Claims, 4 Drawing Sheets

IMPACT PROTECTION DEVICE

FIELD OF THE INVENTION

The present invention relates to a device which reduces the risk of injury or damage occurring when a weapon impacts against a human being or an object.

BACKGROUND

In both military and civilian handling of firearms a large number of accidents occur every year in which injury is caused to people or damage to objects. In the handling of handguns it also happens that, for example, personal injury occurs when teeth are damaged or knocked out, because someone strikes the barrel of the weapon. Such accidents occur on many different occasions, for example in troop transport. In such transport, it is common that the soldiers sit with the weapon in front of them and support the butt of the weapon against the floor. In such instance, the barrel of the weapon is at face height. When the vehicle bumps and shakes while moving, there is a risk that the barrel of the weapon strike some part of the body. On such occasions, facial injuries and injuries to other parts of the body are unfortunately not uncommon.

Also on other occasions, for example on manoeuvres, on embarking or disembarking from means of transport etc., a soldier may be injured by his own weapon or his comrade's weapon. Material, which, for example, accompanies such transport may be damaged when the barrel of a weapon strikes the material.

It is obvious that there is a need for a device which reduces the risk of damage and injury of the above-type.

As regards military weapons, there is a need that the device can be employed regardless of whether the weapon is used for shooting with live or blank ammunition.

SUMMARY OF THE INVENTION

An object of the invention is to provide a device which satisfies the above needs. Hereafter the designation impact protection device will generally be employed for the device according to the invention.

The impact protection device according to the present invention is of a design and includes parts which consist of material which is deformed when the weapon strikes against something. As a rule, the impact protection device is designed such that the portions which are deformed consist of a material which reassumes its original form once the deforming forces aimed at the impact protection device have ceased.

As a result of the capability of the impact protection device to absorb impact and jolts, the risk is reduced that a person be injured or an object be damaged when a weapon with a mounted impact protection device strikes with its muzzle against the person or the object. Naturally, the risk that the weapon itself be damaged is also reduced.

Further objects and features of the present invention will be apparent from the following detailed description.

BRIEF DESCRIPTION OF THE DRAWINGS

The invention will now be described further with the aid of embodiments shown in the accompanying drawings. In the accompanying drawing.

DETAILED DESCRIPTION

Figure 1:
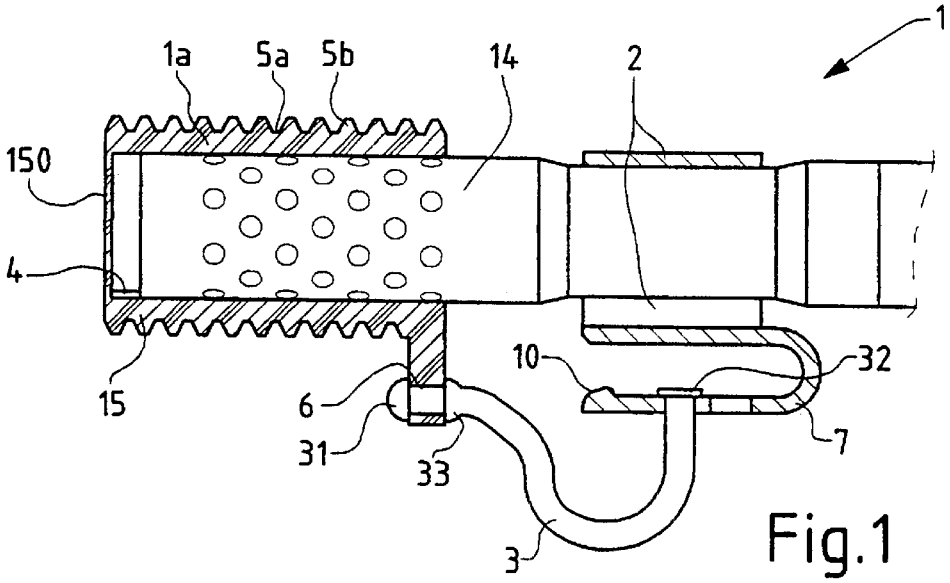
FIG. 1 is a cross-section through an impact protection device according to the present invention mounted on the flashguard of a weapon.

FIGS. 1–5 show one embodiment of an impact protection device 1. In the illustrated embodiment, the device includes an impact protector 1*a* which is manufactured from an elastic material, for example a thermoplastic, a rubber material etc. By the intermediary of a brace 3 of elastic material, for example, rubber, the impact protector is connected to a bracket 2. In FIGS. 1–5, the impact protection device is shown as applied on a flash protector 14, hereinafter generally designated flashguard 14. The flashguard is shown in the Figs. in one embodiment intended to be employed together with a weapon designated Ak 5 (automatic carbine). In use, the flashguard, which is designed to surround the barrel of the weapon when firing, is placed on the front region of the barrel (not shown) of the weapon. The embodiment of the impact protection device shown in the figures is intended to be employed on weapons which are made ready for firing with live ammunition.

A person skilled in the art will realize that the exact configuration of the impact protection device is adapted to the shape of the weapon in question or the flashguard in question, at the same time as the basic features of the impact protection device remain the same.

The impact protect 1 has, in the illustrated embodiment, an outer surface provided with grooves 5*a* surrounded by flanges 5*b* in order to improve the capability of the device to absorb impact, i.e. as a rule to be temporarily deformed in order to absorb impacts and jolts. In other embodiments, the outer surface is smooth, in which event the material is elastic and its thickness is sufficient to absorb impact. Designing the impact protector 1*a* with grooves is a materials saving measure compared with an impact protector with a smooth surface. A distance from the one end region of the impact protector, hereafter referred to as the bottom end portion 15 of the impact protector, a stop member 4 is disposed, which entails that the bottom 150 of the impact protector will, on application of the impact protector, be located a distance from the muzzle of the flashguard 14. As a result, the bottom end portion forms a "deformation zone" ahead of the muzzle, the deformation zone absorbing impact from the weapon from the front.

Figure 4:
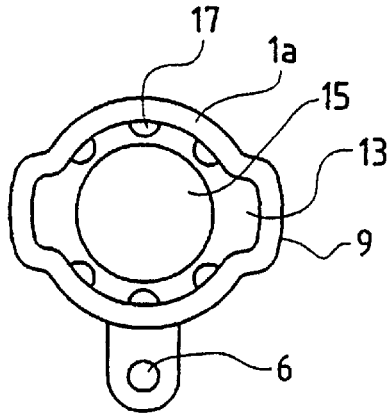
FIG. 4 shows an impact protector which forms part of an impact protection device according to FIG. 1 seen from the rear.
Figure 5:
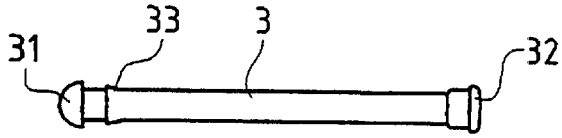
FIG. 5 shows a brace which is included in the impact protection device according to FIG. 1.

It will be apparent from FIG. 4 that the impact protector 1*a* has two recesses 13 on the inside of the impact protector, which form projections 9 on the outside of the impact protector and which are disposed in register with one another. The tension with the recesses 13 is to be able to facilitate application and removal of the impact protector 1*a* by pressing on the projections 9. When the projections are depressed, the cross-section of the impact protector changes its configuration so that the impact protector will be easier to mount on or dismount from the flashguard 14. Learning a reliable technique of applying or dismounting the impact protector is facilitated by the placing of the projection on the outside of the impact protector and by the fact that the simplest way of mounting and dismounting the impact protector is to use the above-described technique. What is to be avoided above all is that anyone places a hand on the bottom of the impact protector and attempts to force it in place on the flashguard. This is a dangerous operation since a shot fired inadvertently will pass through the hand.

On its inside, the impact protector 1 is provided with a number of rigidifying lands 17. In the end portion of the impact protector which is opposed to the bottom end portion 15, the lands 17 are bevelled at the muzzle of the impact protector in order to facilitate mounting in place of the impact protector. As a rule, the lands are located substantially at right angles to the bottom 150. When the impact protector is applied on the flashguard, the lands are oriented substantially parallel with the longitudinal direction of the barrel of the weapon. While the lands 17 shown in FIG. 4 are disposed in the longitudinal direction of the impact protector, in other embodiments they make an angle with the longitudinal direction of the barrel. In yet further embodiments, there are no lands at all.

In the illustrated embodiment, the impact protector 1*a* moreover serves the function of a muzzle guard. Each year, a number of accidents occur with hand firearms depending upon the fact that the bore is not completely clean when a shot is fired. What is blocking the bore is often material, snow, etc which has entered from outside into the bore as a result of careless handling on, for example, transport of the weapon. If a shot is fired, the blockage in the barrel of the gun will cause increase of pressure in the barrel which, in the worst case scenario, will burst. The pressure increase may also result in a fire plume striking the marksman's face.

Figure 2:
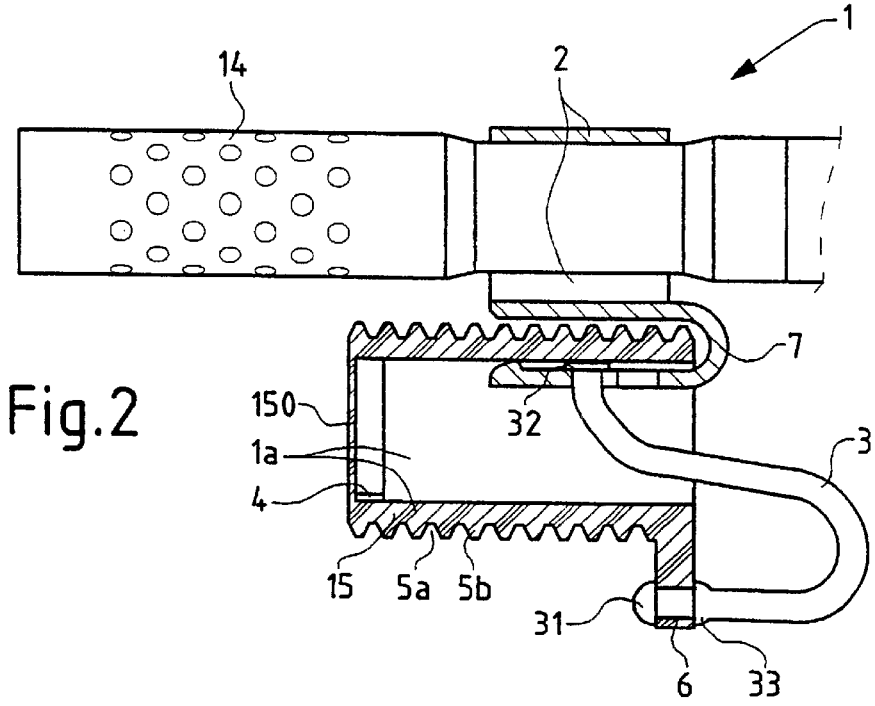
FIG. 2 is a cross-section through the impact protection device according to FIG. 1 in another configuration.
Figure 3:
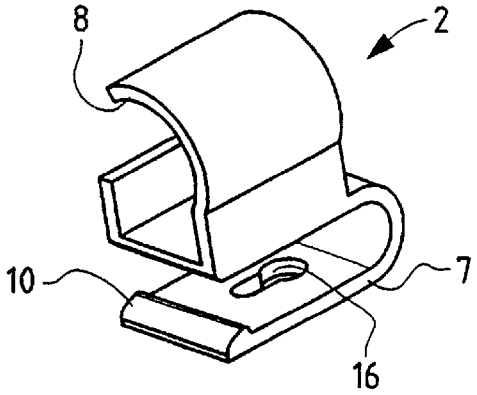
FIG. 3 is a perspective view of a bracket which is included in the impact protection device according to FIG. 1.

The function of the muzzle guard is partly to prevent foreign matter from entering the barrel, and partly to prevent injurious pressure from building up. For this function, the bottom 150 of the impact protector 1*a* is generally formed as a membrane. The membrane is of lesser thickness than the remaining material of the impact protector. The thickness of the membrane is selected such that the membrane ruptures before harmful pressure has built up in the barrel if a shot is fired by mistake with the muzzle guard mounted in place. The intention is, naturally, to remove the impact protector before the gun is fired, in which event the impact protector can be hung on the bracket 2 as shown in FIG. 2. In certain embodiments, indications of fracture are provided in the form of grooves, and in others the membrane is of a thickness which decreases towards its centre.

The bracket 2 which is included in the embodiment of the impact protection device 1 shown in the figures has an arcuate portion 8 which is intended to be secured around the flashguard 14 by being clamped in place as a snap coupling. The bracket 2 is manufactured from a heat-resistant material, which withstands the temperature which the flashguard may reach in the event of automatic fire. The bracket 2 is moreover provided with a hook 7 which displays a through-going, keyhole-shaped aperture 16 in that part of the bracket which faces away from the flashguard. Furthest out on the hook 7 there is, on certain embodiments, a ridge 10 which improves the retention of the impact protector 1*a*.

The brace 3 of elastic material, for example rubber, is press/fit connected in its one end in the aperture 16 in the bracket 2, while the other end of the brace 3 is secured in an aperture 6 disposed on a projecting portion of the impact protector 1*a*. By stretching the brace in order to reduce its diameter and pressing its one end portion 32 into the narrower part of the keyhole-shaped aperture 16, the brace 3 is secured to the bracket 2. Prior to this, the brace 3 has been passed in through the aperture 6 in the impact protector 1*a*. The head 31 of the brace 3 is overdimensioned which prevents it passing through the aperture 6. The projecting portion of the impact protector 1*a* will be clamped between the head 31 and the suitably provided flange 33 in the brace.

When firing with live ammunition, the impact protector 1*a* is removed by pressing on the projections 9 and sliding off the impact protector. The impact protector 1*a* is then suspended on the hook 7 as shown in FIG. 2, the weapon being ready for action. By the form and placing of the brackets 2 and the impact protector 1*a* it will be a natural and simple movement to remove the protector 1*a* and suspend it in the bracket 2, and vice versa. Thanks to the brace 3, the impact protector 1*a* will not be dropped even if it comes loose from the hook 7. The protector 1*a* is simple to mount in place and dismount even in darkness, thanks to the projections 9. A person skilled in the art will perceive that the brace 3 and its securing in the various parts may be put into effect in other ways in other embodiments and that the figures show but one example of how this may be done. Even when the impact protector 1*a* is suspended in the bracket 2, impact damping is afforded in one direction.

In one alternative embodiment of the impact protection device 1 use is made of the impact protector 1*a* alone, i.e. without the bracket 2. The impact protector 1*a* is, in this instance, stored in another manner than that described above when it is not mounted on the barrel of the firearm.

When firing with blank ammunition, the impact protection device 1 intended for firing with live ammunition is removed by snapping off the bracket 2 from the flashguard 14. As a result of the design and construction of the impact protection device, the device is still held together as a unit.

Figure 9:
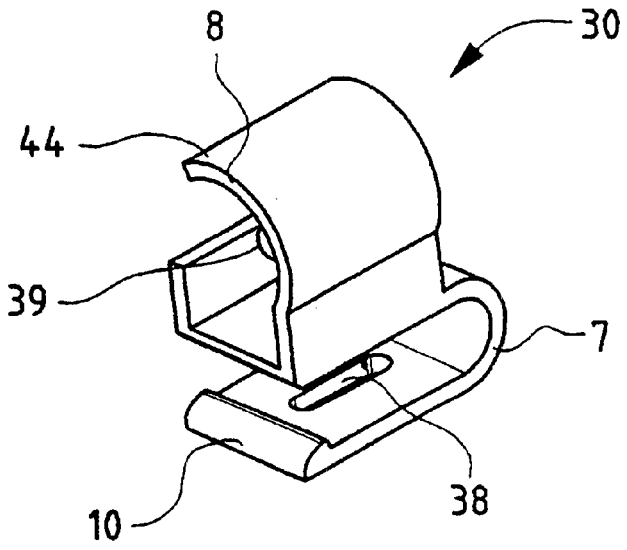
FIG. 9 is a perspective view of an alternative version of a bracket according to the present invention.
Figure 10:
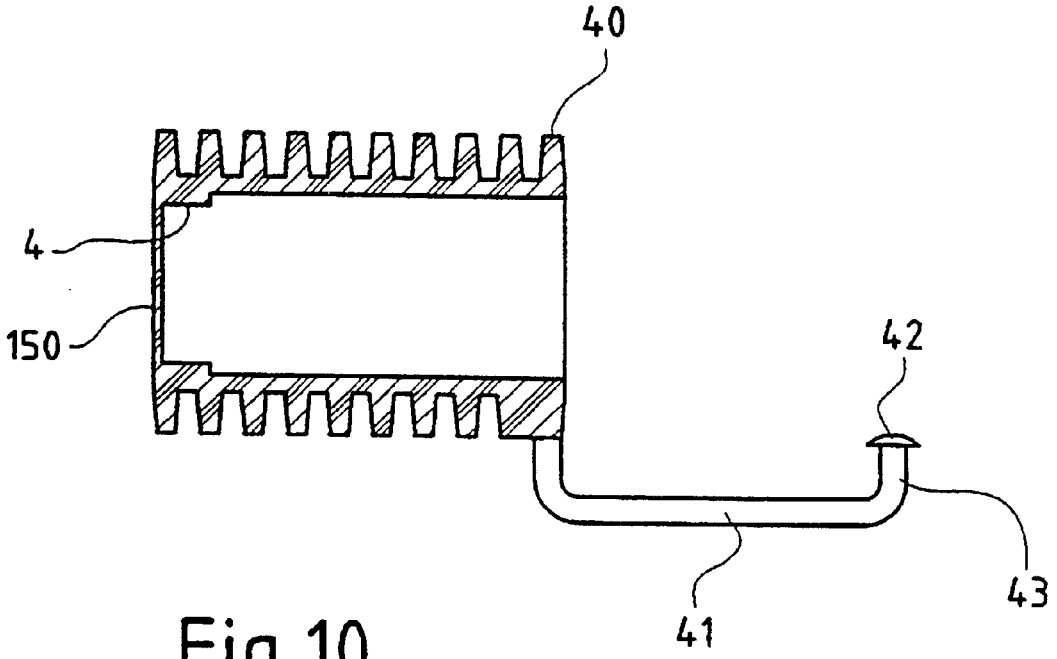
FIG. 10 is a side elevation, partly in section, of an alternative version of a combination of impact protector and brace included in the device.

FIGS. 9 and 10 show an alternative embodiment of the impact protection device. In FIG. 9, the bracket 30 is shown in one embodiment which differs from the bracket 2 described above in three respects. First, the corners 44 of the arcuate portion 8 are rounded and/or the edge between the corners is rounded (not shown in the figure), secondly, the inside of the arcuate portion 8 has been provided with a rib 39, and thirdly the keyhole-shaped aperture has been replaced by elongate aperture or elongate gap 38.

The intention with the rounded corners is that the bracket 30 be easier to mount on and dismount from the flashguard 14. In order to counteract the risk that the bracket 30 is less secure in place because of the rounded corners, the inner side of the arcuate portion 8 is provided with a longitudinal rib 39. The rib 39 intimated in FIG. 9, results in the arcuate portion 8 of the bracket 30 being clamped harder against the flashguard 14.

In the embodiment illustrated in FIG. 10, the brace 41 constitutes an integrated part of the impact protector 1*a* made of elastic material, for example rubber. Normally, the. brace 41 is thus formed simultaneously with the impact protector 1*a*. In other embodiments, the brace 41 is formed as a separate part which, with the aid of welding, gluing, etc, is secured to the impact protector 1*a* in the normal manner.

In the formation of the brace 41, it is provided at its free end with an upwardly curved and relatively configurationly stable portion 43 which terminates with a head 42. The performing of the brace 41 with its upwardly curved portion 43 entails that the brace 41 runs freely in the longitudinal gap 38 of the bracket 30. Normally, the length of the brace 41 is adapted such that the impact protector 1*a* does not come loose from the flashguard 14 until the impact protector 1*a* is pulled by hand forwards and thereby stretches out the elastic brace 41.

In yet a further alternative detailed design (not shown) the flanges 40 of the impact protector 1*a* which are located furthest back (the flange is located on the end opposite to the bottom of the impact protector) are provided with a recess which fits around the curved portion of the hook 7. As a result, it is possible to move the impact protector 1*a* further in on the hook 7, which in turn entails that the impact protector is better fixed on the hook.

A person skilled in the art will perceive that the detailed minor forms which vary between the embodiments may be combined in a number of different ways.

When firing with blank ammunition and using the weapon Automatic Carbine No. 5, a blank firing device 25 (FIGS. 6–8) is fixedly screwed on the weapon ahead of the flashguard 14.

One problem is that the blank firing device 25 rapidly becomes relatively hot, for which reason the impact protection device must withstand high temperatures. In the choice of material and design and construction, the inventors have them taken as their point of departure that the impact protection device must withstand a temperature of at least 300° C.

Figure 6:
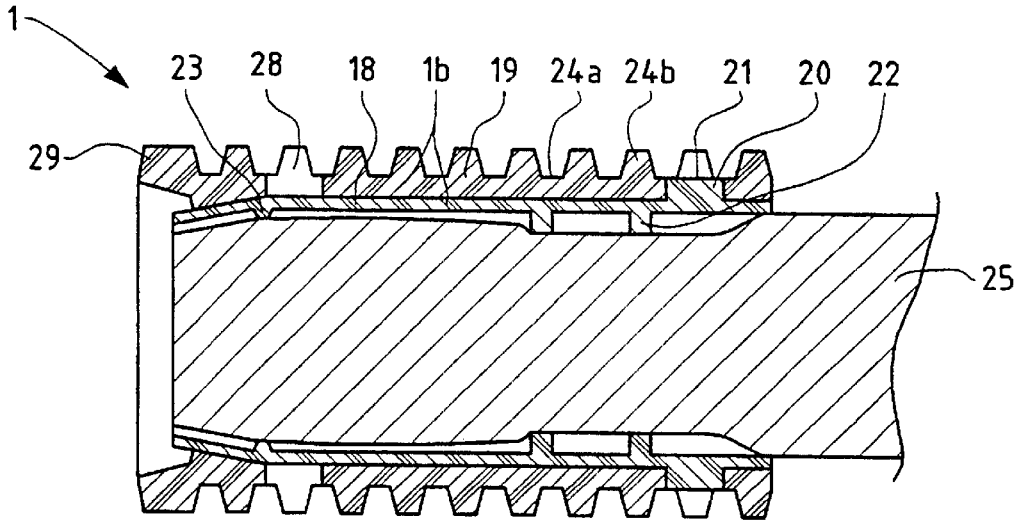
FIG. 6 is a longitudinal section through one embodiment of the impact protection device and a blank fire arrangement on which the impact protection device is placed.
Figure 7:
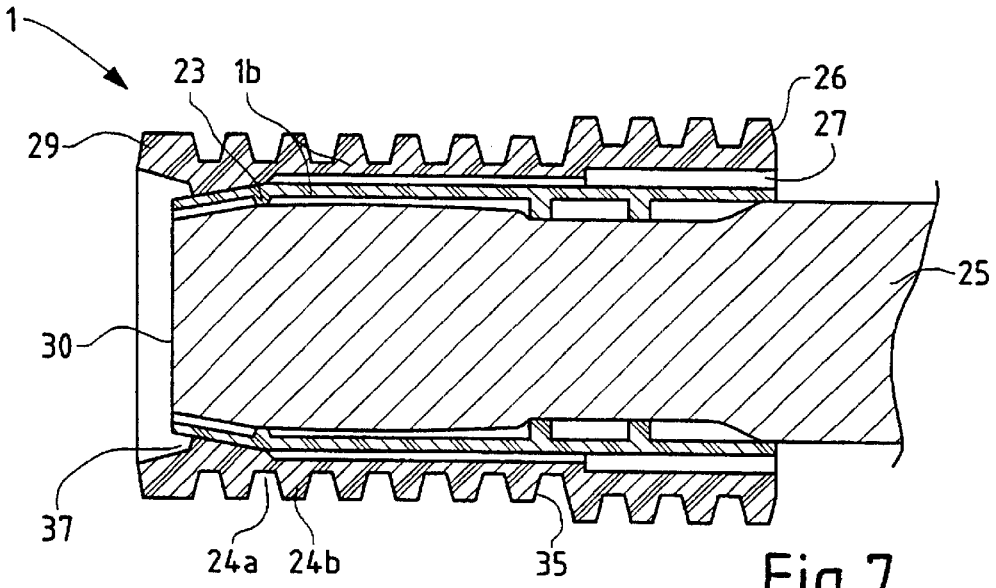
FIG. 7 is a longitudinal section corresponding to that of FIG. 6 turned through 90° in relation to the longitudinal section in FIG. 6.
Figure 8:
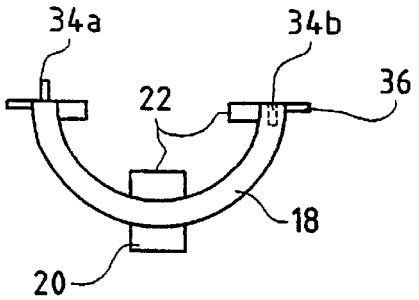
FIG. 8 is an end elevation of a part which is included in the impact protection device according to FIGS. 6 and 7.

In the embodiment illustrated in FIGS. 6–8, an impact protector 1*b* which comprises two parts is included in the impact protection device. The first part constitutes a mechanically rigid inner part 18, hereinafter generally referred to as inner part 18. The other part is an elastic outer part 19, hereinafter generally referred to as outer part 19. Both the inner and outer parts consist of heat-resistant material.

The inner part 18 is, in the illustrated example, of plastic, for example a thermoplastic, and comprises two identical halves which are placed over a blank firing device 25 disposed on the weapon in order to surround it at least in a region most proximal the muzzle of the blank firing device. The outer part 19 of plastic material is then passed on the inner, harder part 18. The outer part 19 here forms a sleeve which holds the inner part 18 in place. In design, construction and choice of material, it has thus been insured that the outer part 19 is sufficiently elastic to be able to be passed on the inner part 18. Once the outer sleeve has arrived in place, the outer and inner parts form the impact protector 1*b* whose function corresponds to that previously described with reference to FIGS. 1–7.

The two halves which form the inner part 18 have been provided with pins 34*a* and holes 34*b* in which the pins enter when the halves are laid together. The form of the inner part 18 is adapted so that it adheres to the form of the blank firing device 25. The inner part 18 has a number of heels 22, 23 which are turned to face towards the blank firing device 25 when the inner part is placed on the blank firing device. It is only these heels 22, 23 which are in direct contact with the possibly hot blank firing device 25, otherwise there is an air gap between the inner part 18 and the blank firing device 25. In the illustrated example, the inner part 18 is in contact with the blank firing device 25 in twelve restricted regions, i.e. there are twelve heels 22, 23.

In order to lead off heat, the inner part 18 has, in the illustrated embodiment, a mesh or grid-like design, but is mechanically rigid. Each half which forms the inner part 18 has a number of rib-like elements which are oriented in the axial direction (longitudinal direction) of the device, and a number of rib-like elements which are oriented transversely of the longitudinal direction (cross-wise). There may be, for example, three elements in the transverse direction and five elements in the longitudinal direction. In alternative embodiments, the inner part is more in the form of a shell with a large number of airholes for leading off heat.

The outer part 19 is made of the same material as the impact protector 1*a* and has the same fundamental construction as the impact protector 1*a* for firing with live ammunition in accordance with the foregoing. The only major difference, apart from the rigid lower part 18 is that the impact-absorbing part 19 normally has no bottom corresponding to that described for the impact protector 1*a*. When firing with blank ammunition, no muzzle guard is needed.

The outer part 19 has been provided with grooves 24*a* and flanges 24*b* in order to provide better impact absorption and in order to save material. In a number of embodiments, the outer part 19 has a smooth surface. In all embodiments, the thickness and elasticity of the material are selected analogous with that previously disclosed for the impact protector 1*a* so that impact is absorbed in a satisfactory manner. The outer part 19 is designed such that the edge of its front portion 29 lies a distance ahead of the front edge of the blank firing device 25, in order to absorb impacts which comes straight from in front.

The outer part 19 has two recesses 27 (FIG. 7) in register with each other and which form projections 26 on the outside. In a plane which, in cross-section, has been turned through 90° in relation to a plane which passes centrally through the recesses 27, the outer part 19 has recesses 21 for receiving pins 20 provided on the outer surface of the inner part 19. The pins 20 have been designed so that their upper surface inclines somewhat forwardly in order to facilitate application of the outer part 19. When the projections 26 are pressed, the outer part 19 is deformed, the recesses 21 disengaging from the pins 20 and the outer part 19 may be taken off. Also when the outer part 19 is to be placed on the inner part 18, the projections 26 are depressed. In such instance, it must be ensured that the recesses 21 and the pins 20 are in register with each other. The inner part 18 has guides 36 which project out from its outer surface and are intended to enter into grooves 35 in the inner surface of the outer part 19. This ensures correct orientation between the inner part 18 and the outer part 19.

For dissipating heat, the outer part 19 is also provided with holes 28 in certain embodiments. In the front portion, the outer part 19 is in contact with material in the inner part only at one or a few regions 37, whereby good ventilation will be obtained.

In the blank firing alternative, the impact protection device is normally in place the whole time and is only removed for weapon care.

When the impact protection device is to be mounted in place for firing with blank ammunition, the two identical halves which form the inner part 18 are laid around the blank firing device 25. In such instance, the pins 34*a* on the one half 18 will enter into holes 34*b* in the other half. Thereafter, the outer part 19 is passed on the inner, united part 18 by pressing the projections 26, ensuring that the guides of the inner part 18 enter into the grooves 35 of the outer part 19. The outer part is passed on so far that the pins 20 on the inner part 19 enter into the recesses 21 in the rear portion of the outer part 19. On removal of the impact protection device, the projections 26 are pressed for lifting the recesses 21 of the outer part from the pins 20 of the inner part. It is then possible to remove the outer part 19 and thereafter separate the inner part 18.

The above detailed description has referred to but a limited number of embodiments of the present invention, but a person skilled in the art will readily perceive that the present invention encompasses a large number of embodiments within the scope of the appended Claims.

What is claimed is:

1. An impact protection device for a firearm comprising an impact protector removably mountable on the firearm, a bracket mountable on the firearm and an elastic brace member connecting said impact protector and said bracket, said bracket including a retainer device which is shaped to receive and securely hold said impact protector when said protector is removed from said firearm.

2. The protection device of claim 1, wherein said impact protector has an outer part of elastic material.

3. The protection device of claim 2, wherein said impact protector includes flanges and recesses in an outer surface of said outer part.

4. The protection device of claim 3, wherein said impact protector projects forwardly on said firearm when mounted thereon.

5. The protection device of claim 4, wherein said impact protector includes a stop for engaging the firearm to position said impact protector forwardly of said firearm when mounted thereon.

6. The protection device of claim 1, wherein said impact member is adapted for mounting on a barrel or a flashguard of the firearm, said impact member including a bottom for covering an open end of the barrel or flashguard.

7. The protection device of claim 6, wherein said bottom is in the form of a membrane.

8. The protection device of claim 1, wherein said impact protector has opposed projections with underlying recesses which are engageable to deform the impact protector to enable the protector to be mounted and dismounted on the firearm.

9. The protection device of claim 8, wherein said impact protector has inner spaced projecting lands to facilitate mounting and dismounting of said impact protector on said firearm.

10. The protection device of claim 1, wherein said brace member is integrally secured at one end to said impact protector and detachable at an opposite end to said bracket.

11. The protection device of claim 10, wherein said bracket has an aperture in which said opposite end of said brace member is engageable.

12. The protection device of claim 12, wherein said bracket includes an arcuate portion for engaging around the firearm, said arcuate portion being longitudinally open and flexible to snap-engage on said firearm.

13. The protection device of claim 12, wherein the arcuate portion of the bracket for engaging the firearm includes a longitudinal rib for engaging the firearm.

14. The protection device of claim 1, wherein said retaining device of said bracket includes a bend portion defining a clearance space in which said impact protector is engageable.

15. An impact protection device for a firearm comprising an impact protector removably mountable on the firearm, said impact protector including a mechanically rigid inner part and an elastic outer part, said inner part being heat resistant and having air holes for cooling the inner part.

16. The protection device of claim 15, wherein said inner part comprises two identical portions which are secured together by pins and corresponding holes in said two identical portions.

17. The protection device of claim 15, wherein said outer part is slidable on the inner part for mounting and dismounting, said inner part including pins which engage in recesses in said outer part when the outer part is slidably engaged on said inner part.

18. The protection device of claim 17, wherein said inner part includes guides for slidable engagement with grooves provided in said outer part.

19. The protection device of claim 15, wherein said inner part is mounted on a blank firing device of said firearm in direct contact in limited regions.

20. The protection device of claim 19, wherein said inner part includes lands for engaging the blank firing device in said limited regions.

21. The protection device of claim 15, wherein said outer part has a forward portion for engaging said inner part in a reduced region thereof.

22. The protection device of claim 15, wherein said outer part includes end projecting portions which are engageable to slidably displace said outer part relative to said inner part.

* * * * *